United States Patent [19]

Plasko

[11] Patent Number: 4,937,551

[45] Date of Patent: Jun. 26, 1990

[54] PTC THERMAL PROTECTOR DEVICE

[75] Inventor: E. Robert Plasko, Lexington, Ohio

[73] Assignee: Therm-O-Disc, Incorporated, Mansfield, Ohio

[21] Appl. No.: 305,641

[22] Filed: Feb. 2, 1989

[51] Int. Cl.[5] ..... H01C 7/00

[52] U.S. Cl. ..... 338/22 R; 338/328; 338/329

[58] Field of Search ..... 338/22 R, 313, 314, 338/322, 328, 329

[56] References Cited

U.S. PATENT DOCUMENTS 4,314,230 2/1982 Cardinal et al. ..... 338/329 X
4,331,860 5/1982 Roller et al. ..... 338/22 R X
4,752,762 6/1988 Inano et al. ..... 338/22 R
4,786,888 11/1988 Yoneda et al. ..... 338/22 R
4,822,980 4/1989 Carbone et al. ..... 338/22 R X

*Primary Examiner*—C. L. Albritton
*Attorney, Agent, or Firm*—Jones, Day, Reavis & Pogue

[57] ABSTRACT

An improved PTC thermal protector device is disclosed wherein the PTC element is protected from excessive mechanical forces such as shear forces that would otherwise significantly degrade PTC performance. The PTC element is protected by one or more adhesive masses in contact with both terminals of the device. The improved PTC thermal protector device does not require the use of specially designed terminals or terminal attachments, yet is simple to assemble on a mass-production basis.

9 Claims, 2 Drawing Sheets

PTC THERMAL PROTECTOR DEVICE

BACKGROUND OF THE INVENTION

This invention relates to a thermal protector device comprising a polymeric PTC element. More particularly, this invention relates to a thermal protector device comprising a polymeric PTC element wherein said element is protected from external forces, especially shear forces, that would otherwise significantly degrade electrical performance of the element.

Thermal protector devices comprising PTC elements are well known. These devices generally comprise a substantially planar polymeric PTC element provided on each broad surface with a conductive foil, and having an electrical terminal soldered to each conductive foil such that the terminals are in electrical contact with the PTC element through the conductive foil. It is further known that the PTC effect of such devices can be significantly degraded when the PTC elements thereof are subjected to mechanical forces applied through one or both of the electrical terminals, such as the shear forces that may occur when the devices are mechanically mounted into an electrical circuit. PTC elements comprising cross-linked polymer are particularly susceptible to such performance degradation.

One prior art solution to the problem, as disclosed in U.S. Pat. No. 4,698,614, issued to Welch et al. and assigned to the common assignee, involves thermal protector device configurations wherein the terminals on either side of the PTC element are mechanically clamped together in such a way that the PTC element is essentially protected against foreign external mechanical forces. In another solution, disclosed in pending U.S. patent application Ser. No. 109,105 filed Dec. 3, 1987 by Yagher, Jr., and also assigned to the common assignee, at least one of the terminals includes a self-supporting spring which provides play between the thermal protector device and the circuit element to which it is mounted. While each of the aforementioned solutions adequately protects the PTC element from deleterious mechanical forces such as shear forces, each also requires the use of specially designed terminals or terminal attachments.

It is thus one object of the invention to provide a PTC thermal protector device wherein the PTC element is protected from external mechanical forces that would otherwise significantly degrade electrical performance of the element, and which does not require the use of specially designed terminals or terminal attachments.

It is yet another object of the invention to provide a PTC thermal protector device wherein the PTC element is protected from external mechanical forces that would otherwise significantly degrade electrical performance of the element, yet which device is simple and easy to assemble on a mass-production basis.

Other objects, advantages, and novel features of the invention will be readily apparent to those skilled in the art in light of the following description and figures.

SUMMARY OF THE INVENTION

In accordance with the invention, a PTC thermal protector device is provided comprising a substantially planar PTC element, a conductive foil on each broad surface of the PTC element, an electrical terminal soldered to each conductive foil, and at least one adhesive mass in contact with both of said terminals to prevent relative movement therebetween, thereby protecting the PTC element from mechanical forces applied to said terminals, particularly shear forces, that would otherwise significantly degrade electrical performance of the element. The adhesive masses are preferably of an electrically insulative material that becomes rigid when cured. In a preferred embodiment, two adhesive masses are used, one at each end of the PTC thermal device.

DETAILED DESCRIPTION OF THE INVENTION

Figure 1:
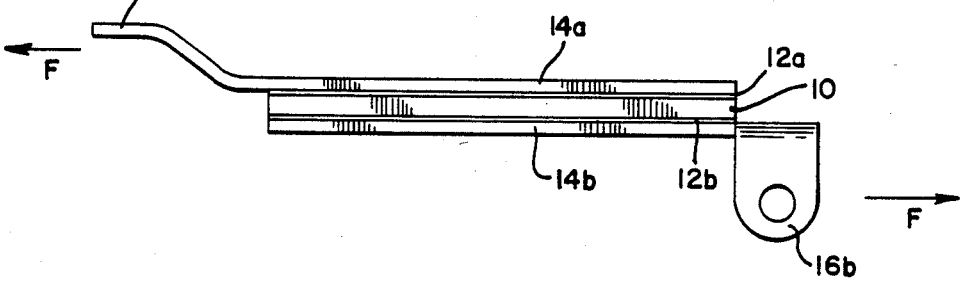
FIG. 1 PRIOR ART
FIG. 1 is an elevational view of a prior art PTC thermal protector device subject to shear forces.

FIG. 1 illustrates the basic components of a PTC thermal protector device of the prior art. A substantially planar PTC polymer element 10 is provided on each of its broad surfaces with conductive foils **12*a* and 12*b*. To the conductive foils 12*a* and 12*b* are soldered electrical terminals 14*a* and 14*b*, respectively. The electrical terminals 14*a* and 14*b* are provided with mounting means 16*a* and 16*b***, by which the PTC thermal protector device is mounted in a circuit. Upon mounting, the PTC thermal protector device may become subject to mechanical forces such as shear forces indicated by the arrows F. These shear forces can be transmitted through one or both terminals to the PTC element, significantly degrading the performance of the PTC element.

Figure 2:
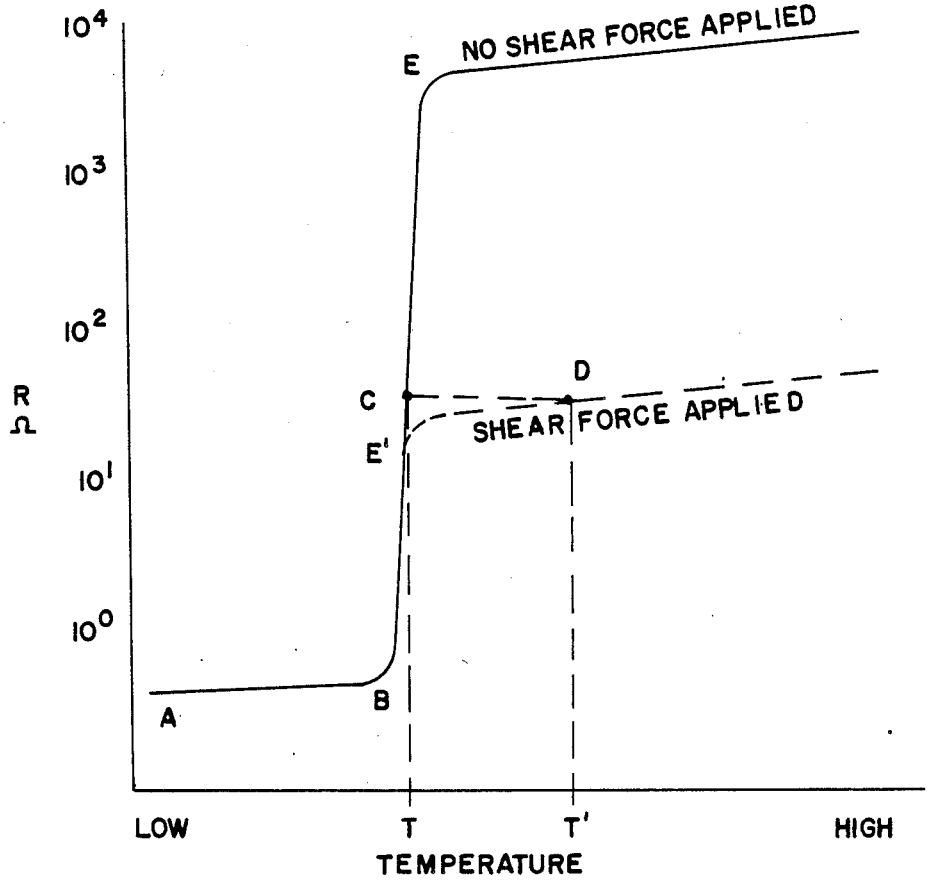
FIG. 2 is a graph of resistance as a function of temperature, showing the change in PTC performance of a hypothetical thermal protector device with and without applied shear forces.

FIG. 2 illustrates temperature-resistance curves for a hypothetical PTC thermal protector device with and without applied shear forces. As current is applied across a PTC thermal protector device, internal heating will cause the temperature of the device to increase from point A to point B on the curve. At point B, the internal resistance increases exponentially, causing a drop in the current passing through the device. A PTC device not subjected to shear forces will exhibit an increased resistance up to point E on the curve corresponding to a temperature T before undergoing a significant increase in temperature. Point C on the curve indicates the equilibrium point a which the heat generated within the device (as a function of $I^2R$) is equal to the heat lost by the device to its environment. A PTC device that is subjected to shear forces, however, may exhibit resistance only up to some point E′ on the curve before undergoing a significant increase in temperature. If point E′ appears at a point lower than equilibrium point C on the curve, then the PTC device subjected to shear forces will have an equilibrium point D at a temperature T′. If the temperature T′ is too high, the circuit may overheat so that the PTC polymer may itself undergo thermal degradation, or the solder between the terminals and the conductive foils may melt. Either condition can result in failure of the PTC thermal protector device with damage to the equipment in which it is placed.

It is apparent that it is important to the proper functioning of a PTC device that the PTC element of the device should be protected from an excessive mechanical force, such as a shear force, that might otherwise significantly degrade PTC performance.

Figure 3:
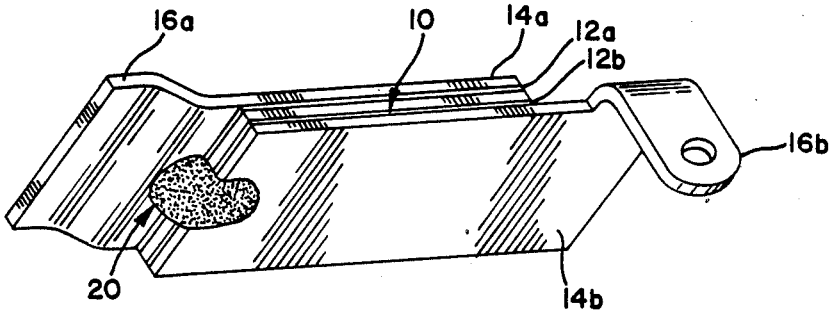
FIG. 3 is a perspective view of a PTC thermal protector device of the instant invention.
Figure 4:
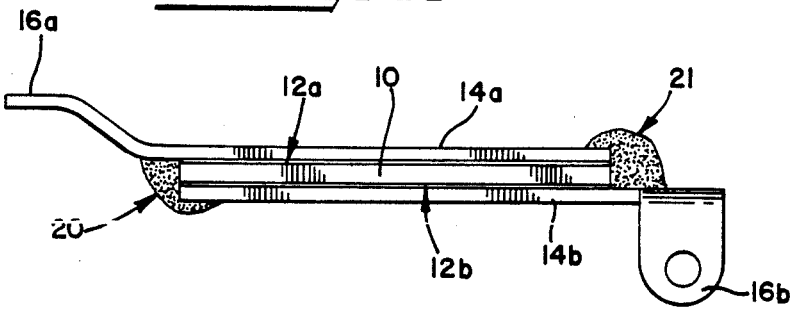
FIG. 4 is an elevational view of a PTC thermal protector device of the instant invention.

In accordance with the invention, an improved PTC thermal protector device provided with a simple means for protecting the PTC element from the application of excessive mechanical forces, such as shear forces, is illustrated in FIGS. 3 and 4. In these figures, components 10, 12*a*, 12*b*, 14*a*, 14*b*, 16*a*, and 16*b* are assembled in the same manner and have the same function as like-numbered components of the prior art device of FIG. 1. As shown in FIGS. 3 and 4, the two terminals 14*a* and 14*b* are secured together by means of adhesive masses 20 and 21. The adhesive masses are sufficiently rigid to prevent significant relative movement between the two terminals 14*a* and 14*b*, thereby protecting the PTC element from the application of excessive sheer forces that would otherwise siqnificantly degrade PTC performance. For convenience and ease of application, the adhesive masses may be of a type that is soft when applied and becomes rigid after a curing or hardening step. Said adhesive masses preferably comprise an epoxy, and preferably are electrically insulative. It may be seen that the adhesive masses 20 and 21 are easily applied to the PTC thermal protector device, such that the device is simple to assemble on a mass production basis. In addition, the use of adhesive masses 20 and 21 is adaptable to a wide variety of PTC thermal protector device design configurations, thereby obviating specially designed terminals or mounting means.

The efficacy of the instant invention in protecting a PTC element from the application of excessive shear forces is illustrated in the following examples.

EXAMPLE 1

This example illustrates the effect of applied shear forces on a PTC thermal protector device of the prior art.

A substantially planar PTC element 12 mils thick consisting of polyethylene blended with carbon black was irradiated to induce approximately 50% cross linking in the polymer. The element was provided with a 1 mil nickel foil on each of its broad surfaces. The foils and element were cut into a 7/16"×¾" rectangle and soldered between two 20 mil brass terminal plates, such that each plate extended beyond an edge of the PTC element, as illustrated in FIG. 1.

One end of one of the brass terminals was mounted and 15 VDC was applied to the PTC element. The temperature at the surface of the chip was approximately 250° F. When a gradually increasing pulling force was applied to the opposite end of the free terminal, thermal runaway was noted by a rapid increase in temperature commencing at about 2 lbs. of applied force (approximately 6 psi). When a gradually increasing pushing force was applied, thermal runaway commenced at about 3 lbs. of applied force (approximately 9 psi).

EXAMPLE 2

The PTC thermal protector device of Example 1 was provided with an adhesive mass at each end thereof as illustrated in FIGS. 3 and 4. Each adhesive mass was a flattened spheroid having a diameter of about ¼" and a thickness of about 0.0052." The adhesive mass was #2214 epoxy, available from the 3M Company of St. Paul, Minnesota. The epoxy was cured for two hours at 250° F., then allowed to cool for two hours.

The device was mounted at one end of one of the brass terminals as in Example 1 and 15 VDC was applied to the PTC element as in Example 1. The device withstood both a 10 lb. pull force and a 10 lb. push force applied to the free terminal without undergoing thermal runaway. The device was thereby protected from a shear force in excess of about 30 psi. The shear strength of the combined adhesive masses was in excess of about 100 psi, as was the strength of the bond between the adhesive and the device. The cross-sectional area of the adhesive masses was such that the combined adhesive masses supported tensile and compressive forces in excess of about 386 psi. These values were within the published limits of the epoxy material used.

EXAMPLE 3

The PTC device of Example 2 was mounted at one end of one of the brass terminals, a 9 lb. dead weight was hung from the free end of the other terminal, and 15 VDC was applied to the PTC element as in Examples 1 and 2. After 15 hours in that condition the device did not undergo thermal runaway.

It may be seen from the foregoing examples that the PTC device of the instant invention protects the PTC element thereof from excessive applied shear forces so as to prevent thermal runaway under typical operating conditions.

The foregoing description of a preferred embodiment is intended to be by way of illustration, and is not intended to limit the scope of the invention as defined in the claims appended hereto. Numerous variations of the foregoing embodiment will be readily apparent to those skilled in the art.

I claim:

1. A thermal protector comprising a substantially planar polymeric PTC element having substantially planar opposite broad surfaces and an outer periphery, electrically conductive foil covering each of said broad surfaces, electrically conductive terminal plates covering said foil on each of said broad surfaces and being soldered thereto, said terminal plates having a thickness substantially greater than the thickness of said foil and normally having the capability of applying detrimental shearing stress to said PTC element generally parallel to said broad surfaces thereof when forces are applied to said terminal plates in generally opposite directions generally parallel to said broad surfaces, a dielectric adhesive mass extending across said outer periphery and being bonded to each said terminal plate only adjacent said outer periphery, said adhesive mass covering a small area of said outer periphery and said terminal plates, and the remaining area of said outer periphery and said terminal plates uncovered by said adhesive mass being completely exposed and uncovered by any other material, said adhesive mass interlocking said terminal plates for preventing same from imparting shearing stress to said PTC element when forces are applied to said terminal plates in generally opposite directions generally parallel to said broad surfaces.

2. The thermal protector of claim 1 wherein said adhesive mass comprises a plurality of spaced-apart discrete adhesive masses.

3. The thermal protector of claim 1 wherein at least one said terminal plate includes an extension extending outwardly beyond said outer periphery, said adhesive mass being bonded to said extension.

4. The thermal protector of claim 3 wherein said extension has one surface facing generally toward said PTC element and an opposite surface, said adhesive mass being bonded to said extension only at said one surface thereof.

5. The thermal protector of claim 1 wherein each said terminal plate has an extension extending outwardly beyond said outer periphery, said extensions extending outwardly in generally opposite directions, said adhesive mass comprising a pair of discrete adhesive masses, one of said pair of said discrete adhesive masses being bonded to one of said extensions and the other of said pair of discrete adhesive masses being bonded to the other of said extensions.

6. The thermal protector of claim 5 wherein each said extension has one surface facing generally toward said PTC element and an opposite surface, said discrete adhesive masses being bonded to said extensions only at said one surface thereof.

7. A thermal protector comprising a substantially planar polymeric PTC element having substantially planar opposite broad surfaces and an outer periphery, electrically conductive foil covering each of said broad surfaces, electrically conductive terminal plates covering said foil on each of said broad surfaces and being soldered thereto, said terminal plates having a thickness substantially greater than the thickness of said foil and normally having the capability of applying detrimental shearing stress to said PTC element generally parallel to said broad surfaces thereof when forces are applied to said terminal plates in generally opposite directions generally parallel to said broad surfaces, a dielectric mechanical interlock interconnecting said terminal plates adjacent said PTC element for preventing said terminal plates from imparting shearing stress to said PTC element when forces are applied to said terminal plates in generally opposite directions generally parallel to said broad surfaces, said mechanical interlock occupying a very small area of said terminal plates and comprising the sole means for interlocking said terminal plates to prevent said terminal plates from imparting shearing stress to said PTC element.

8. The thermal protector of claim 7 wherein said mechanical interlock is connected with said terminal plates only adjacent said outer periphery.

9. The thermal protector of claim 8 wherein said mechanical interlock comprises at least one adhesive mass.

* * * * *